US005231795A

United States Patent [19]

Westfall

[11] Patent Number: 5,231,795

[45] Date of Patent: Aug. 3, 1993

[54] LOCK SHOE SYSTEM FOR HEAVY SASH

[75] Inventor: Norman R. Westfall, Rochester, N.Y.

[73] Assignee: Caldwell Manufacturing Company, Rochester, N.Y.

[21] Appl. No.: 955,291

[22] Filed: Oct. 1, 1992

[51] Int. Cl.[5] ..... E05F 1/00; E05D 13/00

[52] U.S. Cl. ..... 49/446; 49/453; 16/193

[58] Field of Search ..... 16/193, 197; 49/430, 49/446, 453

[56] References Cited

U.S. PATENT DOCUMENTS 2,952,048 9/1960 Graham .
3,054,152 9/1962 Trammell, Jr. .
3,086,259 4/1963 Klein ..... 16/197
3,195,194 7/1965 Young, Jr. .

*Primary Examiner*—John Sipos
*Assistant Examiner*—Carmine Cuda
*Attorney, Agent, or Firm*—Eugene Stephens & Associates

[57] ABSTRACT

A lock shoe system for an especially heavy sash has shoes with lock bolts that can be moved into locking positions by means of a tool that moves a bolt from underneath a shoe so that the bolt interlocks with a lance in the jamb liner. Once the shoes are locked to the jambs, the sash can be lifted off the shoes, moved laterally within the jambs, and angled out of the window for removal. The shoes guide the sash to a centered position as it is returned to its platforms; and when the shoes are unlocked from the jambs, the lock bolts preferably retain the sash on the shoe platforms.

25 Claims, 4 Drawing Sheets

LOCK SHOE SYSTEM FOR HEAVY SASH

FIELD OF INVENTION

This invention involves locking a pair of sash shoes respectively to a pair of window jambs so that a heavy sash supported on the shoes by a counterbalance system can be lifted off the shoes and removed from the window.

BACKGROUND

Removing a heavy sash from a window is a two-person job, because the sash can weigh more than 100 pounds, as often occurs in schools, offices, and institutional buildings. The counterbalance systems for such heavy sash provide correspondingly large upward forces, and locking the shoes in place against the strong counterbalance forces requires more strength and security than is offered by shoe locking systems intended for smaller, residential window sash. Locking shoes for heavy sash have to be strong and rugged, and the security of their locked positions and their sash holding ability must be highly reliable, because of the danger and damage that could come from losing a sash support or accidentally releasing a locked shoe.

As a smaller residential sash is removed from a window, it is usually tilted from its vertical operating plane; and this transfers part of the sash weight from the support shoes to the person holding the sash. This is undesirable when the sash is especially heavy, because a person tilting a heavy sash might find she has more weight than she can handle safely. Also, shoes that accommodate sash tilting are generally more complex than shoes for a sash that remains vertical.

My invention solves these problems by providing strong locking shoes that reliably support and counterbalance a heavy sash and are also reliable at locking in place to allow the sash to be removed from the window. It involves security measures that ensure that the shoes are reliably locked before the sash is removed and that the sash is reliably replaced on its shoe platforms before the shoes are unlocked. It also ensures that the sash is removed from the window in a safe and reliable way and is guided back into operating position as it is replaced on the support shoes.

SUMMARY OF THE INVENTION

My lock shoe system is intended for an especially heavy sash that runs vertically between a pair of window jambs and is removable laterally from between the jambs. Locking shoes that support lower corners of the sash run vertically within the jambs where the weight of the sash is counterbalanced by spring systems arranged within the jambs. Each shoe carries a lock that is movable between a locked position engaging a discontinuity in the window jamb and an unlocked position in which the shoe can move up and down in the jamb clear of the discontinuity. The locks are preferably accessible from the bottom of the shoes for moving the locks between locked and unlocked positions, and I prefer a special tool for accomplishing this. I also prefer that in the unlocked positions, the locks not only clear the jambs but also engage recesses in the sash to lock the sash on the shoe platforms, which are preferably designed for centering the sash between the shoes. When the shoes are locked to the jambs, the sash is released from the platforms and can be lifted and moved laterally within one of the jambs so that it can be angled out of the window and removed. The shoes are shaped for centering the sash on its platforms as it is replaced, and the shoes preferably cannot be unlocked until the weight of the sash is placed back on the shoe platforms.

DRAWINGS

DETAILED DESCRIPTION

Figure 1:
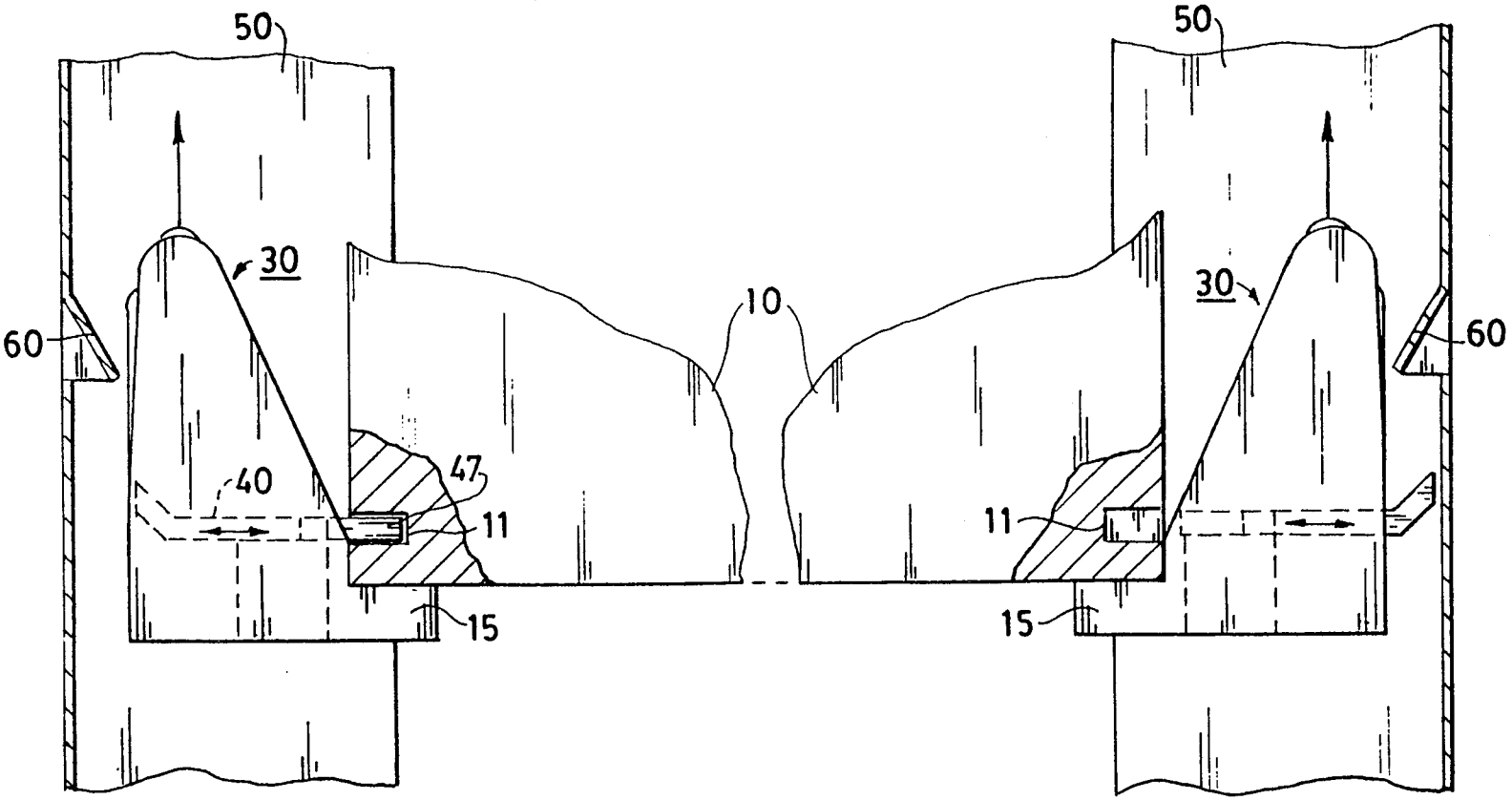
FIG. 1 is a partially schematic and partially cutaway view of a preferred embodiment of my lock shoe system for a heavy sash, showing shoe locks in locked and unlocked positions.
Figure 2:
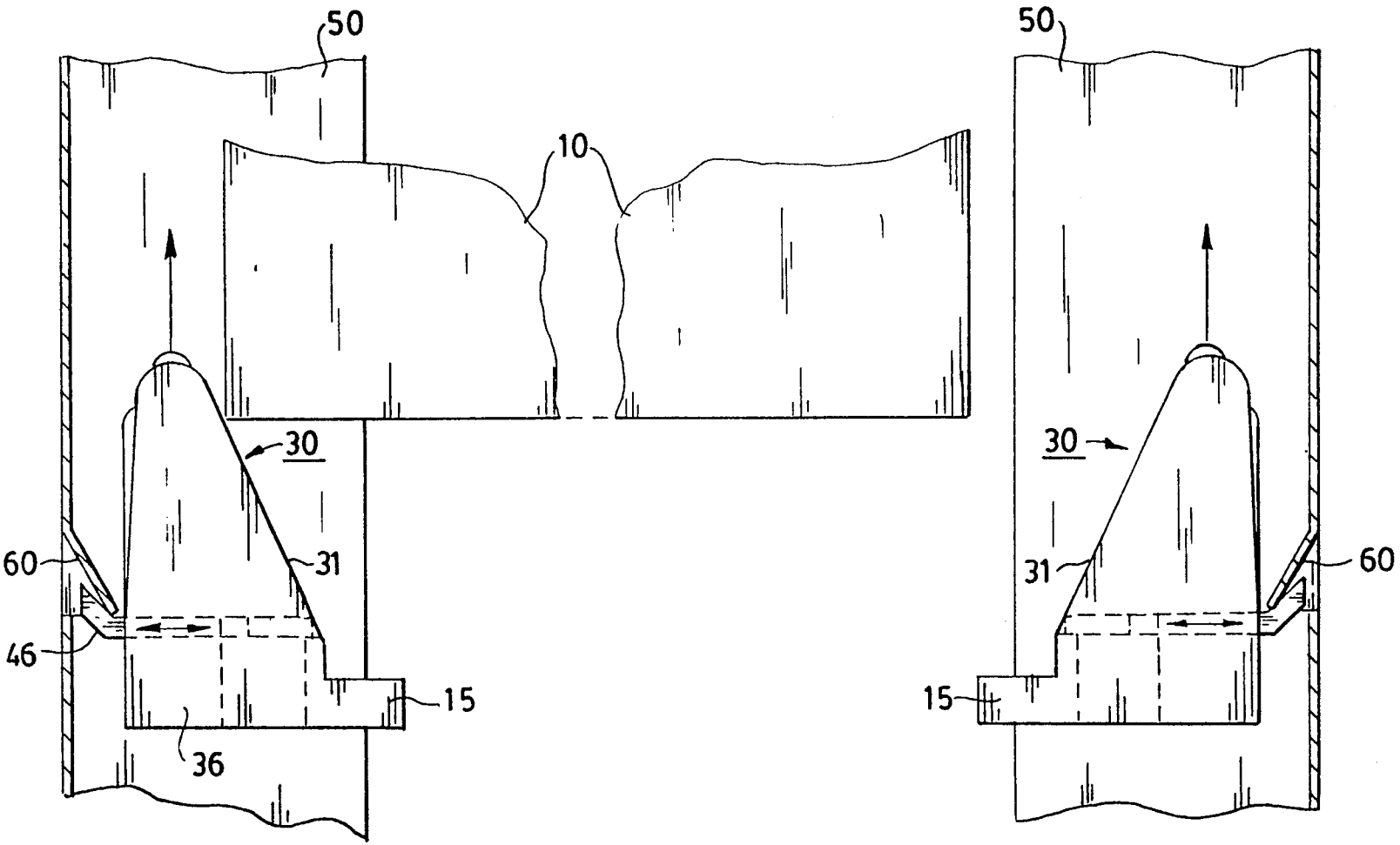
FIG. 2 is a partially schematic and partially cutaway view, similar to the view of FIG. 1, but showing both shoes locked to the window jambs and a window sash moved laterally for withdrawal from the window.
Figure 5:
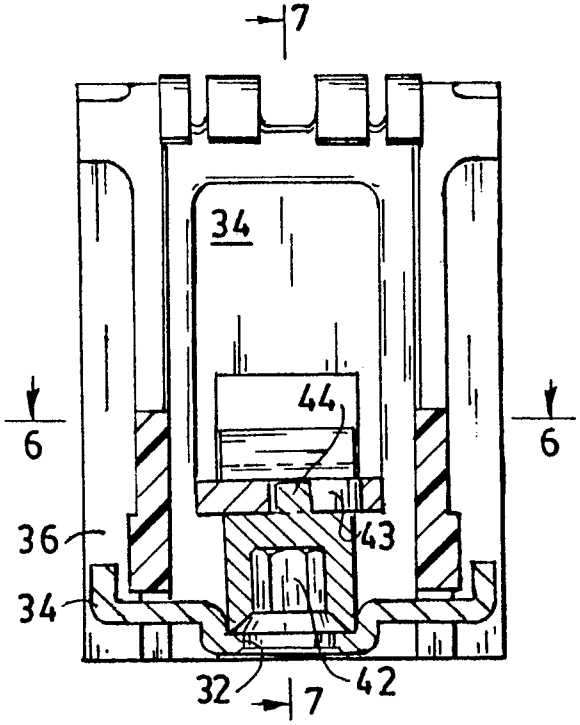
FIG. 5 is a cross-sectional view of the shoe of FIGS. 3 and 4 taken along the line 5—5 of FIG. 3.
Figure 4:
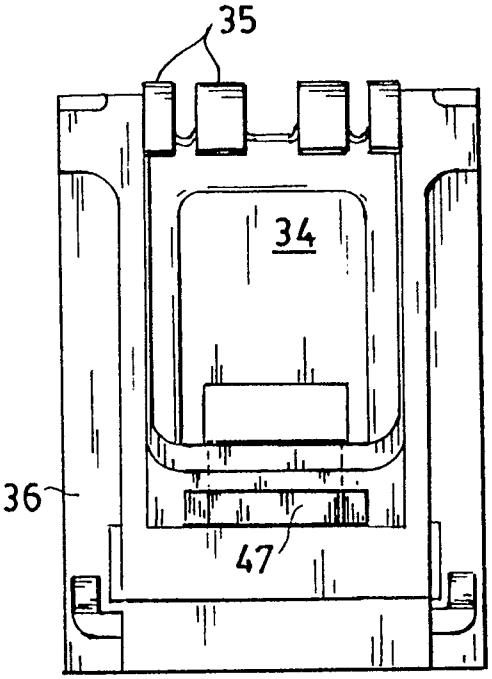
FIG. 4 is an elevational view of the sash side of the shoe of FIG. 3.
Figure 3:
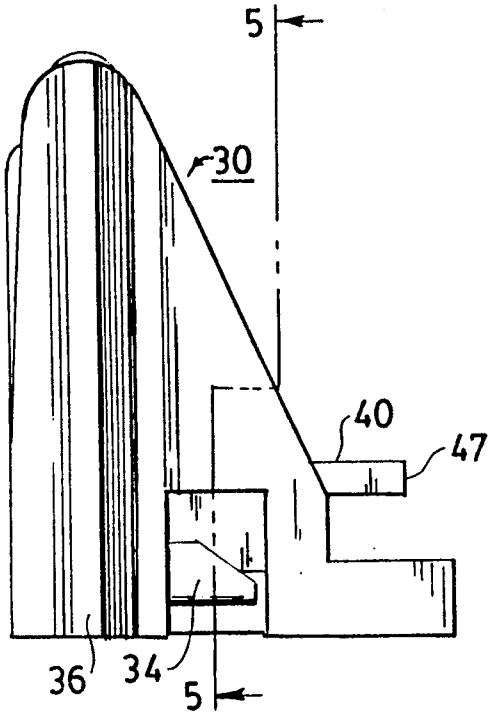
FIG. 3 is a side elevational view of a preferred embodiment of a lock shoe according to my invention.
Figure 6:
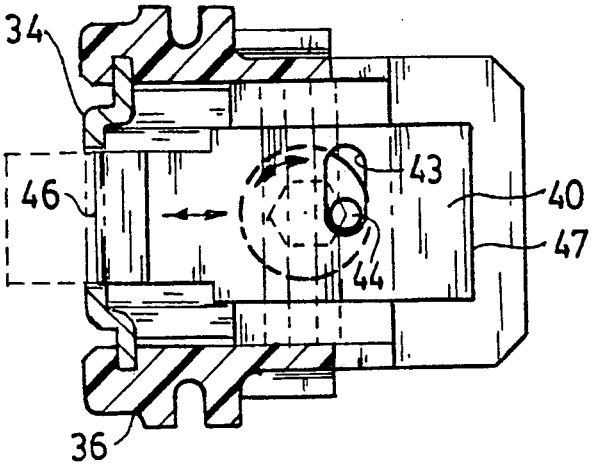
FIG. 6 is a cross-sectional view of the shoe of FIGS. 3–5 taken along the line 6—6 of FIG. 5.

FIGS. 1 and 2 generally show how my lock shoe system operates. A sash 10, which is presumed to be large and heavy, has its lower corners supported on platform 15 of a pair of counterbalance shoes 30. These are connected at their upper regions to a counterbalance spring system that is not shown in the drawings, but is represented by the vertical arrows in FIGS. 1 and 2. The spring system exerts a strong upward counterbalance force on shoes 30, for counterbalancing the heavy weight of sash 10.

A pair of window jambs 50 overlap the stile edges of sash 10 and provide opposed vertical runs for the stiles of sash 10. Jambs 50 also house shoes 30 in vertical channels in which shoes 30 run as sash 10 is raised and lowered. Jambs or jamb liners 50 are normally formed of a metal, such as aluminum, for large and heavy sash; and they also normally include configurational details that have been omitted from the drawings for simplicity.

My invention involves the way shoes 30 support and connect with sash 10 and lock to jambs 50 so that sash 10 can be removed from the window. These operations are schematically shown in FIGS. 1 and 2, and some of the details that allow shoes 30 to achieve their effects are shown in FIGS. 3–8.

Each shoe 30 has a locking element or bolt 40 that can move between locked and unlocked positions, and each jamb 50 has a discontinuity or lance 60 with which a bolt 40 can interlock. When bolts 40 are locked under lances 60, as shown in FIG. 2, shoes 30 cannot rise in response to counterbalance spring forces, and sash 10 can be lifted off of platforms 15. Once sash 10 is lifted, it can also be moved laterally, as shown in FIG. 2, so that a sash stile clears one of the jambs 50, and the sash can then be angled out of the window and removed. This is a two-person job, since sash 10 is heavy.

Sash 10 can be replaced by reversing the process. To do this, one stile edge of sash 10 is moved laterally into a jamb 50 until sash 10 is clear of the opposite jamb 50 and can be angled into the plane of the window. Then sash 10 is moved laterally until both its stile edges are within the runs in jambs 50, and sash 10 is lowered onto platforms 15. Shoe surfaces 31, which slope outwardly and upwardly above platforms 15, guide sash 10 downward toward a centered position between shoes 30 as it is lowered onto platforms 15. There, sash 10 is held against lateral movement between jambs 50, until sash 10 is again raised up from platforms 15. I prefer that in the operating position of sash 10 on platforms 15, as shown in FIG. 1, lock bolts 40 lock sash 10 onto platforms 15 from which sash 10 cannot be lifted until shoes 30 are locked to jambs 50.

A preferred structure for shoes 30 to accomplish the operations explained above is shown in FIGS. 3–8. Connectors 35 at upper regions of shoes 30 are hook-shaped for interconnecting with counterbalance spring elements. For heavy sash 10, counterbalance spring elements are preferably combinations of tension and torsional springs; and a pair of connectors 35 are provided at the top of each shoe 30 so that a pair of counterbalance spring elements can be connected to each shoe 30, if necessary to provide adequate counterbalance force.

Since shoes 30 require considerable strength between connectors 35 and platforms 15, a bracket 34 that is preferably formed of metal is shaped to extend between these two regions. The upward force of a counterbalance spring system applied to connectors 35 is thus transmitted via bracket 34 to the region of platform 15, for supporting a lower corner of sash 10.

Figure 7:
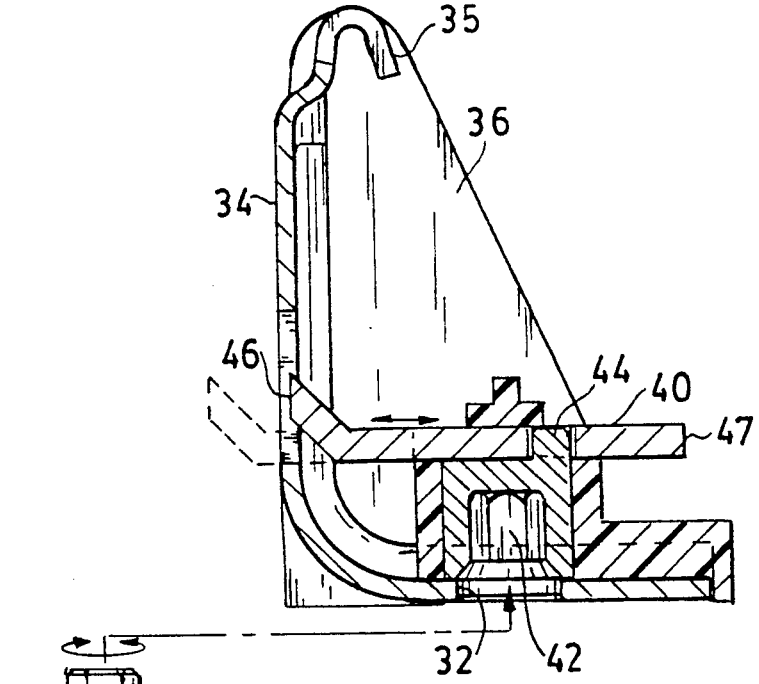
FIG. 7 is a cross-sectional view of the shoe of FIGS. 3–5 taken along the line 7—7 of FIG. 5 and showing a preferred tool for locking and unlocking the shoe.
Figure 8:
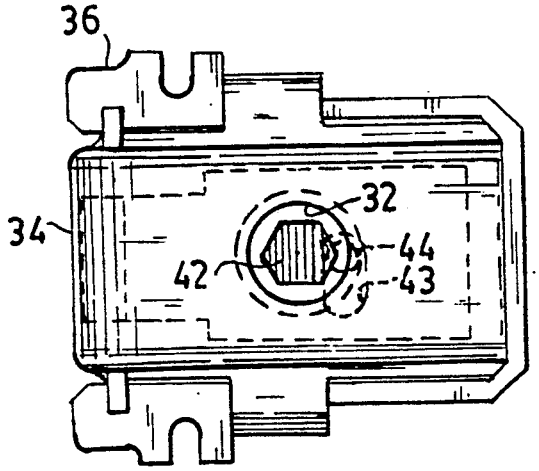
FIG. 8 is a bottom view of the shoe of FIGS. 3–5.

Locking elements or bolts 40 are preferably made to slide laterally between two positions on each shoe 30. A cam 41 or other mechanism is arranged for moving locks 40 between these positions; and as best shown in FIG. 7, cam 41 has a recess 42 shaped for receiving a tool 45 for rotating cam 41. Recess 42 and tool 45 can be six-sided, respectively, so that tool 45 operates like an allen wrench. An eccentric projection 44 on cam 41 moves in an oblong slot 43 in lock bolt 40, to slide the lock bolt laterally when cam 41 rotates. An opening 32 in bracket 34 allows access to cam 41 from the underside of shoe 30 near each lower corner of sash 10.

To lock the shoes 30 in place, it is necessary to raise sash 10 somewhat above the window sill but to a position that is below jamb lances 60 so that someone can reach in under sash 10 and operate tool 45 for rotating each cam 41 to move lock bolts 40 outward to the locked positions shown in FIG. 2. Then when sash 10 is lifted upwardly, shoes 30 follow along with sash 10 until lock bolts 40 engage lances 60. This stops the upward travel of shoes 30 and allows sash 10 to be lifted up off of platforms 15, as shown in FIG. 2.

The upper surfaces of the locking ends 46 of lock bolts 40 preferably incline upwardly, as illustrated, so that when interlocked with lances 60, as shown in FIG. 2, lock bolts 40 cannot be unlocked without the weight of sash 10 being present on platforms 15. The strong upward force of the counterbalance springs on shoes 30 has to be overcome to move shoes 30 slightly downward to unlock upturned locking ends 46 from lances 60; and manually turning cams 41 provides inadequate force to accomplish this, unless the weight of sash 10 is resting on platforms 15. This ensures that shoes 30 cannot be accidentally unlocked until sash 10 is replaced.

The inward or sash end of lock bolts 40 preferably interlocks with sash 10 when shoes 30 are unlocked and sash 10 is resting on platforms 15. In effect, bolts 40 lock to sash 10 when unlocked from jambs 50 and vice versa. This ensures that either sash 10 is locked to shoes 30 or shoes 30 are locked to jambs 50.

A preferred way of interlocking bolt ends 47 with sash 10 is by a discontinuity or recess 11 formed in each lower corner of sash 10, as shown in FIG. 1. Projections or other discontinuities in sash 10 can also be used.

The upwardly inclined locking ends 46 of bolts 40 also serve another function. If bolts 40 are moved to an unlocked position in a region above jamb lances 60, shoes 30 will not lock to jambs 50, but will continue to rise upward with sash 10. If sash 10 is then lowered to move shoes 30 below lances 60, these will cam bolt ends 46 back to an unlocked position as they slide downward over the inclined upper surfaces of lances 60. This returns bolts 40 to the normal operating position in which they interlock with sash 10.

The several parts of shoe 30 are preferably held in assembled relationship by means of a molded resin housing 36. This is configured to provide recesses movably enclosing cam 41 and bolt 40 and holding these parts in proper assembled relationship with bracket 34. Resin housing 36 has a complex shape that preferably snap fits over bracket 34 to entrap bolt 40 and cam 41 in operating position. Bracket 34 also has a complex shape helping to give it the necessary strength and durability.

Locking elements for shoes 30 can pivot, rather than slide; and different arrangements can be made for moving locking devices between positions. Shoes 30 can also be configured in other ways, to meet different sash and jamb requirements. Altogether, though, the illustrated arrangement is preferred for conveniently and satisfactorily performing all the necessary functions in a low cost lock shoe that is strong, reliable, and durable.

I claim:

1. A lock shoe system for a heavy sash movable vertically between a pair of window jambs, said system including a shoe running vertically in each jamb on each side of side sash, each of the shoes having a platform supporting a lower corner of said sash, and each of said shoes being connected to a counterbalance, said system comprising:

a. said platform on said shoes being configured to center said sash between said shoes when said sash is resting on said platforms and to allow said sash to move laterally relative to said shoes when said sash is lifted from said platforms;

b. each of said shoes having lock bolts that slide laterally relative to said shoes and said jambs between locked and unlocked positions;

c. said bolts being accessible from beneath said platforms for moving said bolts between said positions;

d. said jambs having opposed discontinuities configured for interlocking with said bolts in said locked positions to prevent upward movement of said shoes;

e. said sash being movable upwardly from said platforms and laterally of said shoes when said shoes are in locked positions with said bolts engaging said discontinuities, for removing said sash from between said jambs; and f. said discontinuities being lances that are angled downward toward said sash from vertical wall portions of said jambs, and said bolts having upwardly angled locking ends that cannot be retracted from engagement with said lances without the downward force of the weight of said sash being applied to said platforms.

2. The system of claim 1 wherein said jamb discontinuities extend toward said sash from vertical wall portions of said jambs so that said bolts can be moved to said locked positions below said discontinuities and can rise into interlocked relation with said discontinuities.

3. The system of claim 1 wherein said lances and said bolts are configured so that if said bolts are placed in said locked positions above said lances, said bolts are cammed into said unlocked positions as said bolts move downward to positions below said lances.

4. The system of claim 1 wherein said shoes have surfaces inclined outwardly above said platforms to accommodate lateral movement of said sash when lifted above said platforms.

5. The system of claim 1 wherein said shoes include cams arranged for sliding said locks between said positions.

6. The system of claim 5 including a tool insertable into said shoes from beneath said platforms for rotating said cams to slide said locks.

7. The system of claim 1 wherein said lock in said unlocked position engages said sash to prevent said sash from being lifted from said platform.

8. The system of claim 7 wherein said shoes include cams arranged for sliding said locks between said positions.

9. The system of claim 8 including a tool insertable into said shoes from beneath said platforms for rotating said cams to slide said locks.

10. In a locking system for counterbalancing a heavy sash movable vertically between a pair of window jambs, said system including a pair of shoes having platforms supporting lower corners of said sash and connectors for connecting with counterbalance spring mechanisms, the improvement comprising:

a. each of said shoes having a bolt laterally slidable between locked and unlocked positions each of said bolts having an upwardly angled locking end;

b. each of said jambs having discontinuities at the same vertical level for receiving said bolts in said locked positions to lock said shoes against upward movement in response to force provided by said counterbalance mechanisms;

c. said jamb discontinuities extending toward said sash so that said bolts can be moved to said locked positions below said discontinuities and can rise into interlocked relation with said discontinuities when said sash and said platforms rise;

d. said bolts being accessible from regions beneath said platforms for movement between said locked and unlocked positions; and e. said sash being liftable upwardly from said platforms and movable laterally of said shoes for removal from between said jambs when said shoes are in said locked positions.

11. The improvement of claim 10 wherein said bolts and said discontinuities interlock at angles inclined above horizontal so that said bolts cannot be moved out of said locked position without the downward force of the weight of said sash being applied to said platforms.

12. The improvement of claim 11 wherein said discontinuities are lances that are angled downward toward said sash from vertical wall portions of said jambs.

13. The improvement of claim 12 wherein said bolts and said lances are configured so that if said bolts are in said locked positions above said lances and said sash is moved downwardly, said lances cam said bolts to said unlocked positions.

14. The improvement of claim 16 wherein said shoes have surfaces inclined upwardly and outwardly above said platforms to center said sash between said shoes when said sash is on said platforms and to accommodate lateral movement of said sash when said sash is lifted above said platforms while said shoes are locked in said jambs.

15. The improvement of claim 10 wherein said shoes include cams that are rotatable for sliding said bolts between said locked and unlocked positions.

16. The improvement of claim 10 wherein said cams have tool-receiving recesses by which said cams can be rotated.

17. The improvement of claim 10 wherein each of said shoes includes a metal support bracket extending underneath said sash and up to said connector.

18. The improvement of claim 10 wherein said bolts in said unlocked position engage said sash to prevent said sash from being lifted from said platforms.

19. A shoe locking system for a heavy sash counterbalanced by shoes moving vertically within a pair of jambs and having platforms supporting lower corners of said sash, said system comprising:

a. a bolt carried on each of said shoes to be slidable between outward and inward positions;

b. said shoes including cams that are rotatable for sliding said bolts between said outward and inward positions;

c. said cams having tool-receiving recesses by which said cams can be rotated;

d. said lower corners of said sash having discontinuities that receive said bolts in said inward positions to lock said sash in an operating position on said platforms where said sash is centered between said jambs;

e. said jambs having discontinuities for receiving said bolts in said outward positions to lock said shoes against vertical movement in response to counterbalance force;

f. said bolts in said inward positions being clear of said jamb discontinuities to allow said platforms to move vertically with said sash; and g. said bolts in said outward positions being clear of said sash discontinuities to allow said sash to be lifted from said platforms and moved laterally of said platforms.

20. The system of claim 19 wherein said sash discontinuities are recesses formed in stiles of said sash.

21. The system of claim 19 wherein said jamb discontinuities are lances that are angled downward toward said sash from vertical wall portions of said jambs.

22. The system of claim 21 wherein said bolts have upwardly angled ends that interlock with said lances and cannot be retracted from engagement with said lances without the force of the weight of said sash being applied to said platforms.

23. The system of claim 19 wherein said shoes have surfaces inclined outwardly above said platforms to accommodate lateral movement of said sash when lifted above said platforms.

24. The system of claim 19 wherein said jamb discontinuities project from said jamb toward said sash so that said bolts can be moved to said outer positions below said discontinuities and can rise with said sash and said shoes into interlocks with said discontinuities.

25. The system of claim 24 wherein said jamb discontinuities are lances that are angled downward toward said sash from vertical wall portions of said jambs and said bolts have upwardly angled ends that interlock with said lances and cannot be retracted from engagement with said lances without the force of the weight of said sash being applied to said platforms.

* * * * *